US008764488B2

(12) United States Patent
Zeng

(10) Patent No.: US 8,764,488 B2
(45) Date of Patent: Jul. 1, 2014

(54) CONNECTOR HAVING BRIDGE MEMBER FOR COUPLING GROUND TERMINALS

(75) Inventor: Tie-Wu Zeng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 315 days.

(21) Appl. No.: 13/348,810

(22) Filed: Jan. 12, 2012

(65) Prior Publication Data

US 2012/0184145 A1 Jul. 19, 2012

(30) Foreign Application Priority Data

Jan. 14, 2011 (CN) ..... 2011 1 0008421

(51) Int. Cl.
*H01R 13/516* (2006.01)
*H01R 13/648* (2006.01)

(52) U.S. Cl.
USPC ..... 439/626; 439/108

(58) Field of Classification Search
USPC ..... 439/92–108, 626
See application file for complete search history.

(56) References Cited

U.S. PATENT DOCUMENTS

| | | | | |
|---|---|---|---|---|
| 5,429,520 | A * | 7/1995 | Morlion et al. | 439/108 |
| 6,039,583 | A * | 3/2000 | Korsunsky et al. | 439/101 |
| 6,095,864 | A * | 8/2000 | Yu et al. | 439/607.01 |
| 6,146,202 | A | 11/2000 | Ramey et al. | |
| 6,220,896 | B1 | 4/2001 | Bertoncini et al. | |
| 6,394,822 | B1 * | 5/2002 | McNamara | 439/108 |
| 6,471,548 | B2 | 10/2002 | Bertoncini et al. | |
| 6,506,076 | B2 | 1/2003 | Cohen et al. | |
| 6,712,646 | B2 | 3/2004 | Shindo | |
| 6,780,059 | B1 * | 8/2004 | Payne et al. | 439/607.39 |
| 7,320,623 | B2 * | 1/2008 | Hisamatsu et al. | 439/607.01 |
| 7,435,132 | B1 * | 10/2008 | Fong et al. | 439/497 |
| 8,545,240 | B2 * | 10/2013 | Casher et al. | 439/108 |
| 2006/0068640 | A1 * | 3/2006 | Gailus | 439/608 |
| 2006/0211299 | A1 * | 9/2006 | Takaya et al. | 439/507 |
| 2008/0194146 | A1 * | 8/2008 | Gailus | 439/608 |
| 2009/0221165 | A1 * | 9/2009 | Buck et al. | 439/108 |
| 2009/0221167 | A1 | 9/2009 | Pittenger et al. | |
| 2011/0070774 | A1 | 3/2011 | Huang | |
| 2011/0269346 | A1 | 11/2011 | Casher et al. | |

FOREIGN PATENT DOCUMENTS

| | | |
|---|---|---|
| CN | 201639092 | 11/2010 |
| WO | 2010/068671 | 5/2010 |

* cited by examiner

*Primary Examiner* — Briggitte R Hammond
(74) *Attorney, Agent, or Firm* — Ming Chieh Chang; Wei Te Chung

(57) ABSTRACT

A connector (100) includes an insulative housing (1), a first and second ground terminals (211, 212), a first differential pair (213) and a bridge (3). The first differential pair is supported by the insulative housing (1) and positioned between the first and the second ground terminals. The bridge couples the first and the second ground terminals and disposed at an inner side of the insulative housing.

20 Claims, 6 Drawing Sheets

CONNECTOR HAVING BRIDGE MEMBER FOR COUPLING GROUND TERMINALS

BACKGROUND OF THE INVENTION

1. Field of the Invention

The present invention relates to a connector suitable for high-speed communication, and more particularly to a connector having a bridge member or bridge for coupling ground terminals.

2. Description of Related Art

U.S. Pat. No. 7,841,872 discloses a connector including an insulative housing and a plurality of terminals received in and supported by the insulative housing. The terminals include a row of first terminals and a row of second terminals separated from each other. The first terminals include a first ground terminal, a second ground terminal, and a differential pair positioned between the first and second ground terminals. U.S. Patent Application Publication No. 2011/0269346 further discloses a bridge coupling the first and second ground terminals to improve the electrical performance in high-speed communication. However, the bridge extends outside of an edge of the insulative housing, which causes an increase in the size of the profile of the insulative housing, and the bridge also may undesirably contact with an external component.

Hence, a connector having an improved structure for coupling ground terminals is desired.

SUMMARY OF THE INVENTION

Accordingly, an object of the present invention is to provide a connector having a small size and a secure connection between ground terminals.

In order to achieve the object set forth, the invention provide a connector includes an insulative housing, a row of first terminals, a row of second terminals, and a bridge. The insulative housing has a first wall, a second wall, and a receptor slot defined between the first and second walls. The row of first terminals are supported by the insulative housing and protruding from the first wall into the receptor slot. The row of first terminals include a first ground terminal, a second ground terminal, and a first differential pair positioned between the first and second ground terminals. The row of second terminals are supported by the insulative housing and protruding from the second wall into the receptor slot. The row of second terminals include a third ground terminal, a fourth ground terminal, and a second differential pair positioned between the third and fourth ground terminals. The row of first terminals and the row of second terminals are separated from each other along a front-to-back direction to define a locating space therebetween. The bridge electrically couples the first ground terminal with the second ground terminal. The bridge is positioned in the locating space, which means the bridge extending inside of an edge of the insulative housing. Therefore, the bridge is less possible to engage with an external component and the connector could be a small size.

For a further improvement, the bridge could be a metal plate or PCB (printed circuit board) which provides a simple connection between the ground terminals.

Other objects, advantages and novel features of the invention will become more apparent from the following detailed description when taken in conjunction with the accompanying drawings.

DETAILED DESCRIPTION OF THE PREFERRED EMBODIMENT

Figure 1:
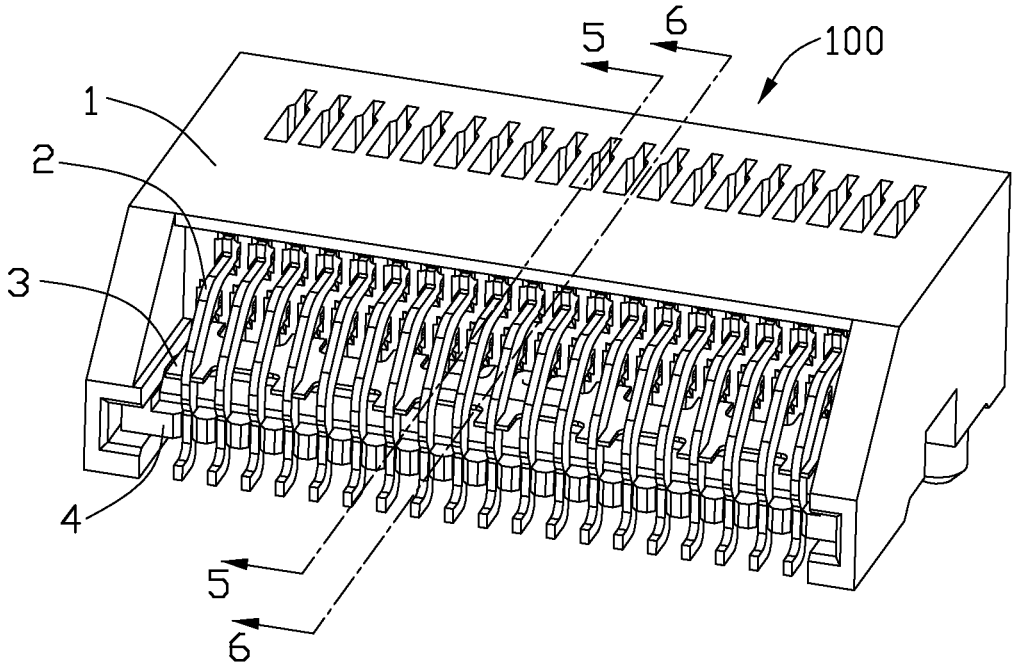
FIG. 1 is an assembled perspective view of a connector in accordance with the present invention.

Reference will now be made in detail to the preferred embodiment of the present invention.

Referring to FIGS. 1-6, a connector 100 according to an embodiment of the present invention includes an insulative housing 1, a plurality of terminals 2 received in and supported by the insulative housing 1, an elongated spacer 4 retained in the insulative housing 1, and a bridge 3 disposed above the spacer 4.

The insulative housing 1 has an upper wall 12, a lower wall 13, and a receptor slot 11 defined by the upper and lower walls 12, 13. The upper wall 12 has an array of upper openings 121 intercommunicating with the receptor slot 11. The lower wall 13 has an array of lower openings 131 intercommunicating with the receptor slot 11. The insulative housing 1 also has two side walls 18 defining a rear receiving room 14 behind the receptor slot 11. The insulative housing 1 also has an array of upper retention slots 15 and an array of lower retention slots 16 intercommunicating with the receptor slot 11 and the rear receiving room 14. Furthermore, the insulative housing 1 includes two slipping slots 17 disposed at two side walls 18 and intercommunicating with the receiving room 14.

Figure 3:
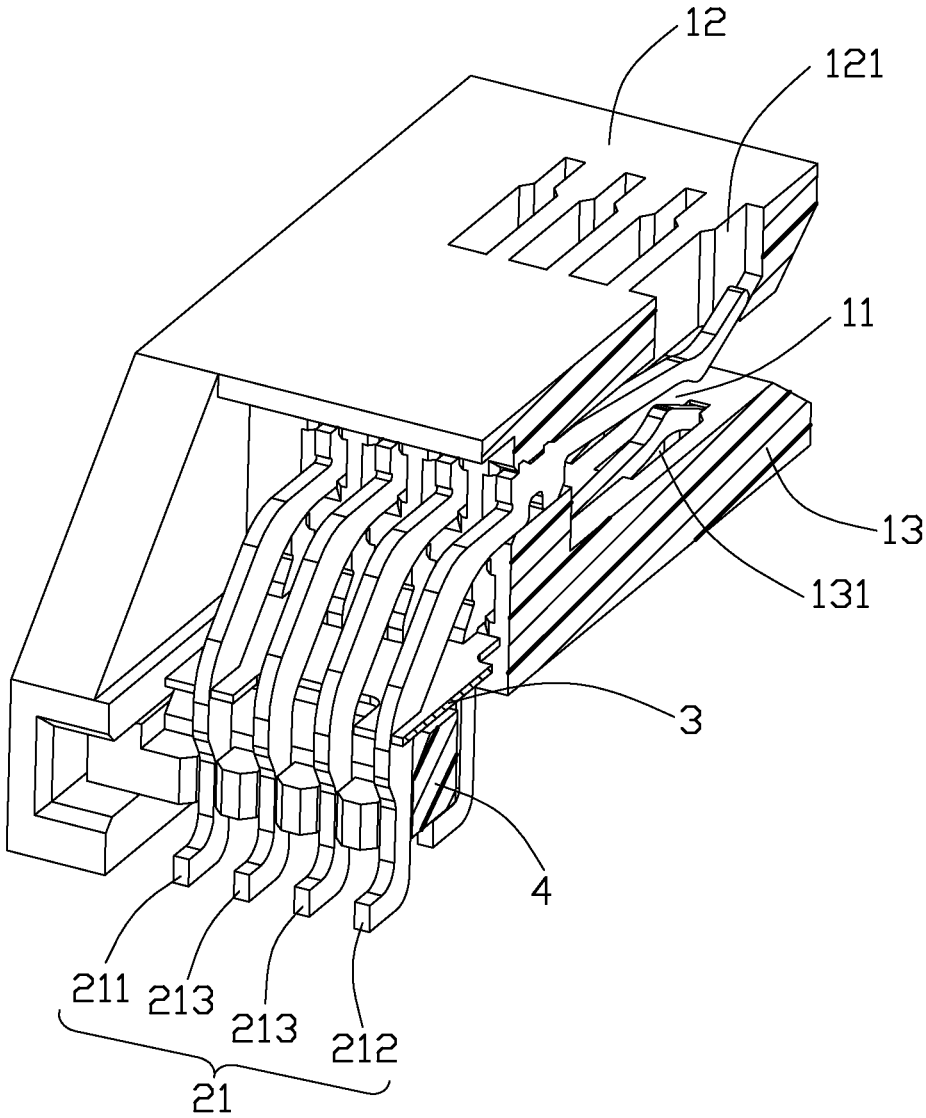
FIG. 3 is a longitudinally cut-away perspective view of the connector shown in FIG. 1.
Figure 4:
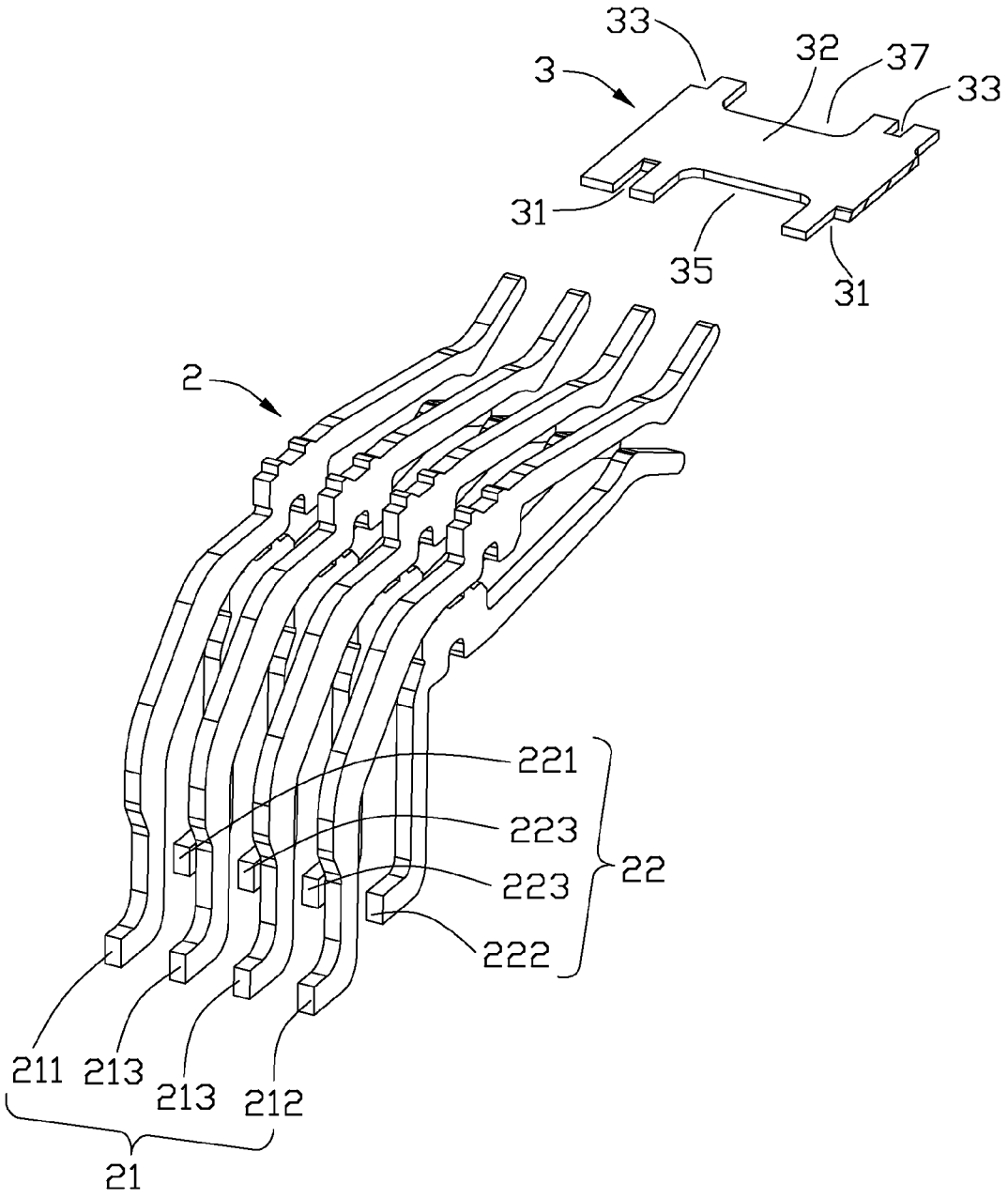
FIG. 4 is an exploded view of terminals and a bridge shown in FIG. 3, with an insulative housing and a spacer thereof being removed.

Referring to FIGS. 3-4, the plurality of terminals 2 include a row of first terminals 21 and a row of second terminals 22. The row of first terminals 21 and the row of second terminals 22 are separated from each other along a front-to-back direction to define a locating space therebetween. The row of first terminals 21 are located above and offset with respect to the row of second terminals 22. The first terminals 21 include a first ground terminal 211, a second ground terminal 212, and a first differential pair 213 disposed between the first and second ground terminals 211, 212. The second terminals 22 include a third ground terminal 221, a fourth ground terminal 222, and a second differential pair 223 disposed between the third and fourth ground terminals 221, 222.

Figure 5:
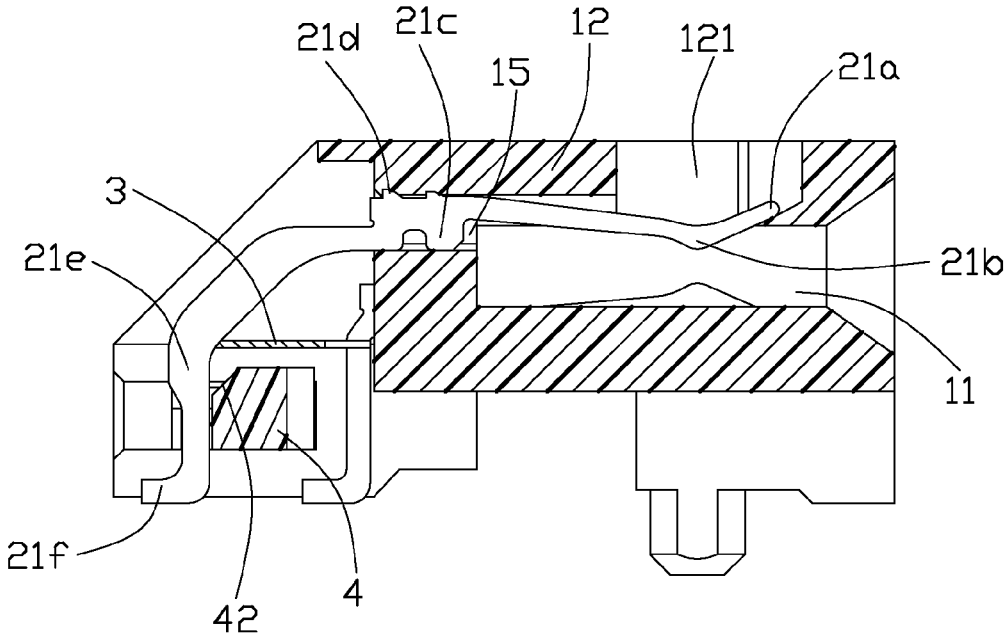
FIG. 5 is a cross-sectional view of the connector of FIG. 1, taken along line 5-5.
Figure 6:
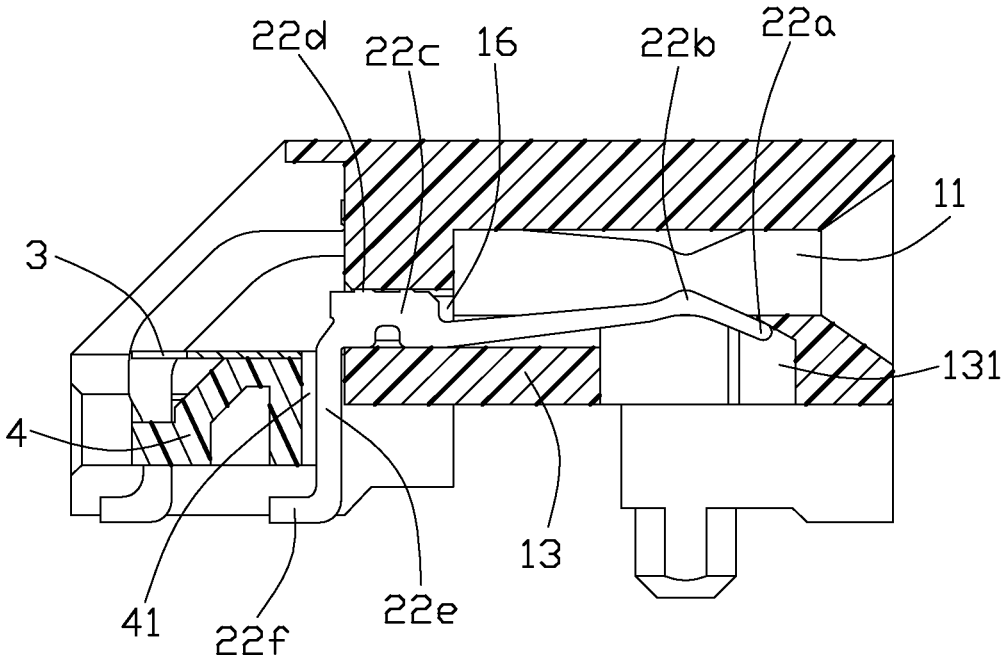
FIG. 6 is a cross-sectional view of the connector of FIG. 1, taken along line 6-6.

Each first terminal 21 has a front end portion 21*a*, a contact portion 21*b*, a retention portion 21*c*, a vertical portion 21*e*, and a rear end portion 21*f* connecting with each other (FIG. 5). Each second terminal 22 has a front end portion 22*a*, a contact portion 22*b*, a retention portion 22*c*, a vertical portion 22*e*, and a rear end portion 22*f* connecting with each other (FIG. 6). The retention portion 21*c* has a barb 21*d* extending upwardly. The retention portion 22*c* has a barb 22*d* extending upwardly. The contact portions 21*b*, 22*b* are used for effect mating engagement with another mating component, not shown, but typically an edge or circuit card of an opposing, mating connector. The rear end portions 21*f*, 22*f* are used for connecting with an outer device, not shown, but typically a mother circuit board.

Referring to FIGS. 3-4, the bridge 3 is a planar metal plate having a main portion 32 constituted of a conductive member, two first cutouts 31, a first recess 35, two second cutouts 33, and a second recess 37. The first cutouts 31 are disposed at a rear edge of the bridge 3 and the first recess 35 is disposed between two first cutouts 31. The second cutouts 33 are disposed at a front edge of the bridge 3 and the second recess 37 is disposed between two second cutouts 33. A second cutout 33 is offset with respect to a first cutout 31. The second recess 37 is offset with respect to the first recess 35.

Figure 2:
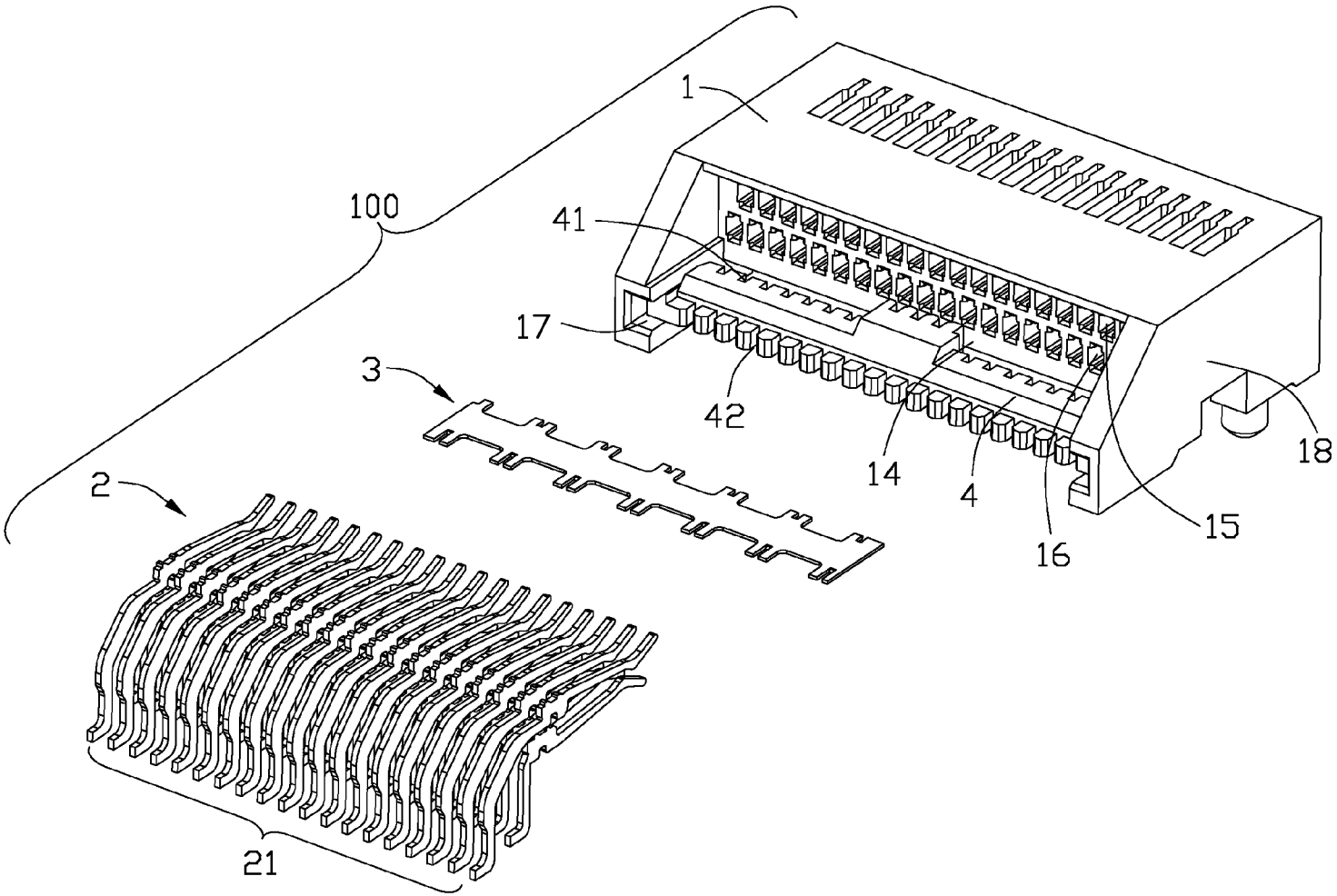
FIG. 2 is a partially exploded view of the connector shown in FIG. 1.

Referring to FIG. 2, the elongated spacer 4 includes an array of front passageways 41 and an array of rear passageways 42. The front and rear passageways 41, 42 are disposed at two opposite edges of the spacer 4 respectively and extend through the spacer 4 from a top-to-bottom direction.

In assembling, the second terminals 22 are firstly inserted into the lower retention slots 16 and the receptor slot 11 (FIG. 6). A front end portion 22*a* of each second terminal 22 is inserted and pre-press fit in a lower opening 131, a contact portion 22*b* protrudes upwardly into the receptor slot 11 from the lower wall 13, a retention portion 22*c* is received and held in the lower retention slot 16, a barb 22*d* engages with an inner wall above the lower retention slot 16.

The spacer 4 is secondly assembled into the slipping slots 17 (FIG. 2), and a vertical portion 22*e* of each second terminal 22 is received and held in a front passageway 41.

The bridge 3 is thirdly assembled to the second terminals 22 and disposed transversely in the locating space between the first and second terminals 21, 22. Consequentially, the bridge 3 extends inside of an edge of the insulative housing. The bridge 3 is less possible to engage with an external component and the connector 100 could be made into a small size. A vertical portion 22*e* of each of the third and fourth ground terminals 221, 222 passes through a second cutout 33 along a top-to-bottom direction and electrically connects with the main portion 32. Two vertical portions 22*e* of the second differential pair 223 pass through a second recess 37 along a top-to-bottom direction and are insulated from the main portion 32.

The first terminals 21 are fourthly inserted in the upper retention slots 15 and the receptor slot 11 just like as the second terminals 22 inserted in the lower retention slots 16 (FIG. 5). A vertical portion 22*e* of a first terminal 21 is received and held in a rear passageway 42. A vertical portion 21*e* of each of the first and second ground terminals 211, 212 is inserted in a first cutout 31 and electrically connected with the main portion 32. Two vertical portions 21*e* of first differential pair 213 are interposed in a first recess 35 and insulated from the main portion 32.

A vertical portion 21*e*,22*e* of the first to fourth ground terminals 211, 212,221, 222 could be fixed in a first or second cutout 33 and electrically connect with the main portion 32 via friction fit or soldering way. A vertical portion 21*e*, 22*e* of the first and second differential pairs 213, 223 could be insulated from the main portion 32 via an air gap or a dielectric member. The air gap is a distance in the depicted FIGS, which advantageously provides good electrical separation and less material than a dielectric member way. In the depicted FIGS, the first and second terminals 21, 22 include a plurality of ground terminals 211, 212, 221, 222 electrically connected with each other by the main portion 32, which advantageously provides a good electrical performance than partial connection.

The bridge 3 is set as a plate and the ground terminals connecting with the bridge through a snap fit, which provides a simple connection therebetween. The bridge 3 does not need to engage with an insulative housing resulting in assembling difficult, which is disclosed in the U.S. Patent Pub NO. 2011/0269346. The bridge 3 also does not need to change the ground terminals structure for coupling with each other which otherwise may implicate impedance mating issue. It is noted that the bridge 3 is not limited to a metal plate. It could be made into such as a PCB (printed circuit board), a FPC (Flexible Printed Circuit board) or other forms for electrically connecting. Each bridge 3 has a conductive member for coupling the ground terminals. In the case of a metal plate, the conductive member is the metal plate itself. In the case of a PCB or FPC, the conductive member is a conductive trace or traces on substrate.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A connector for mounting on a circuit board, comprising:

an insulative housing having a first wall, a second wall, and a receptor slot defined between the first and second walls;

a row of first terminals supported by the insulative housing and protruding downwardly into the receptor slot, the row of first terminals including a first ground terminal, a second ground terminal, and a first differential pair positioned between the first and second ground terminals;

a row of second terminals supported by the insulative housing and protruding upwardly into the receptor slot, the row of second terminals including a third ground terminal, a fourth ground terminal, and a second differential pair positioned between the third and fourth ground terminals, the row of first terminals and the row of second terminals separated from each other along a front-to-back direction to define a locating space therebetween; and a bridge positioned in the locating space and electrically coupling the first ground terminal with the second ground terminal.

2. The connector as claimed in claim 1, wherein said bridge is a planar plate having a conductive member electrically connecting with the first and second ground terminals, the first differential pair being insulated from the conductive member.

3. The connector as claimed in claim 2, wherein said bridge extends transversely in the locating space and has a pair of first cutouts, the first and second ground terminals passing through the first cutouts along a top-to-bottom direction respectively and electrically connecting with the conductive member.

4. The connector as claimed in claim 3, wherein said bridge has a first recess positioned between the pair of first cutouts, the first differential pair passing through the first recess along the top-to-bottom direction and being insulated from the conductive member through an air gap.

5. The connector as claimed in claim 3, wherein said first and second ground terminals are interference fit in the pair of first cutouts, respectively.

6. The connector as claimed in claim 3, wherein said first and second ground terminals are soldered in the pair of first cutouts.

7. The connector as claimed in claim 3, wherein said bridge electrically couples the first, second, third, and fourth ground terminals.

8. The connector as claimed in claim 7, wherein said bridge has a pair of second cutouts, the first and second cutouts disposed at two opposite edges of the bridge, the third and fourth ground terminals passing through the second cutouts along the top-to-bottom direction respectively for electrically connecting the conductive member.

9. The connector as claimed in claim 2, wherein said bridge is a metal plate, said conductive member being of metal material.

10. The connector as claimed in claim 2, wherein said bridge is a circuit board, said conductive member being of a conductive trace.

11. The connector as claimed in claim 2, further comprising an elongated spacer supported by said insulative housing, said spacer defining a plurality of slots extending therethrough along a top-to-bottom direction for receiving the first and second terminals, the bridge disposed at the upper side of the spacer.

12. The connector as claimed in claim 11, wherein said bridge is supported by the spacer.

13. An electrical connector comprising:

an insulative housing defining a front mating port;

two rows of terminals disposed in the housing in a transverse direction, each of the terminals defining, in a front-to-back direction perpendicular to said transverse direction, a front mating section exposed in the mating port for mating with a complementary connector, and a rear mounting section for mounting to a printed circuit board;

each row of terminals including grounding terminals and differential pair terminals alternately arranged with each other in the transverse direction; and a grounding plate located between two rows of terminals in said front-to-back direction around the corresponding rear mounting sections; wherein said grounding plate defines plural structures mechanically and electrically connected to the rear mounting sections of the corresponding grounding terminals, respectively.

14. The electrical connector as claimed in claim 13, wherein said structure defines a fork configuration to sandwich the rear mounting section of corresponding grounding terminal.

15. The electrical connector as claimed in 13, wherein the rear mounting sections of the two rows of terminals are categorized with an inner row and an outer row and are configured to allow the grounding plate to be assembled with regard to the housing only after the terminals of the inner row are assembled into the housing and before the terminals of the outer row are assembled into the housing.

16. The electrical connector as claimed in claim 15, further including an insulative spacer configured to be only forwardly assembled to the housing in the front-to-back direction and located under the grounding plate in a vertical direction perpendicular to both said transverse direction and said front-to-back direction and between the rear mounting sections in the inner row and the outer row.

17. The electrical connector as claimed in claim 16, wherein said rear mounting sections of the terminals are configured to allow the spacer to be assembled with regard to the housing only after the terminals of the inner row are assembled into the housing and before the terminals of the outer row are assembled into the housing.

18. An electrical connector comprising:

an insulative housing defining a front mating port;

two rows of terminals disposed in the housing in a transverse direction, each of the terminals defining, in a front-to-back direction perpendicular to said transverse direction, a front mating section exposed in the mating port for mating with a complementary connector, and a rear mounting section for mounting to a printed circuit board;

each row of terminals including grounding terminals and differential pair terminals alternately arranged with each other in the transverse direction;

a grounding plate located between two rows of terminals and mechanically and electrically connected to the corresponding grounding terminals; and an insulative spacer located between two rows of terminals in said front-to-back direction around the corresponding rear mounting sections; wherein said insulative spacer defines plural structures mechanically engaging the rear mounting sections of all the corresponding terminals, respectively.

19. The electrical connector as claimed in claim 18, wherein the housing and the spacer are configured to allow the spacer to be only forwardly assembled into the housing in the front-to-back direction, and said rear mounting sections of said terminals are categorized with an inner row and an outer row and are configured to allow the spacer to be assembled with regard to the housing only after the terminals of the inner row are assembled into the housing and before the terminals of the outer row are assembled into the housing.

20. The electrical connector as claimed in claim 19, wherein the grounding plate is configured to be assembled with regard to the housing only after the terminals of the inner row are assembled into the housing and before the terminals of the outer row are assembled into the housing.

* * * * *